United States Patent [19]

Asano

[11] 4,119,072

[45] Oct. 10, 1978

[54] CLOSED LOOP AIR FUEL RATIO CONTROL SYSTEM USING EXHAUST COMPOSITION SENSOR

[75] Inventor: Masaharu Asano, Yokohama, Japan

[73] Assignee: Nissan Motor Company, Ltd., Yokohama, Japan

[21] Appl. No.: 806,347

[22] Filed: Jun. 14, 1977

Related U.S. Application Data

[62] Division of Ser. No. 664,226, Mar. 5, 1976, abandoned.

[30] Foreign Application Priority Data

Jul. 3, 1975 [JP] Japan ..... 50-26959
Jul. 3, 1975 [JP] Japan ..... 50-26960

[51] Int. Cl.[2] ..... F02M 7/00; F02B 3/00

[52] U.S. Cl. ..... 123/119 EC; 123/32 EE; 60/276

[58] Field of Search ..... 60/276, 285; 123/32 EE, 123/119 EC

[56] References Cited

U.S. PATENT DOCUMENTS

| | | | |
|---|---|---|---|
| 3,796,200 | 3/1974 | Knapp | 60/285 |
| 3,903,853 | 9/1975 | Kizlek | 123/32 EE |
| 3,910,241 | 10/1975 | Fujisawa et al. | 123/32 EE |
| 3,939,654 | 2/1976 | Creps | 60/276 |
| 3,986,352 | 10/1976 | Casey | 60/276 |

*Primary Examiner*—Ronald B. Cox
*Attorney, Agent, or Firm*—Lowe, King, Price & Becker

[57] ABSTRACT

In a closed loop air fuel ratio control system, a throttle position detector senses full throttle operation. Means are provided to disable or clamp the closed loop to a minimum control level to permit reduction in the air fuel ratio below the stoichiometric value. The engine is allowed to operate with increased fuel to give more output power than is provided by the stoichiometric air fuel ratio.

1 Claim, 7 Drawing Figures

CLOSED LOOP AIR FUEL RATIO CONTROL SYSTEM USING EXHAUST COMPOSITION SENSOR

CROSS REFERENCE TO A RELATED DISCLOSURE

The present application is a division of application Ser. No. 664,226, filed on Mar. 5, 1976; and now abandoned.

FIELD OF THE INVENTION

The present invention relates to a closed loop air fuel ratio control system for motor vehicles, and particularly to a control system in which closed loop control is momentarily disabled or clamped to a minimum to permit reduction in the air fuel ratio below the stoichiometric value to increase the engine output power to meet the heavy loading or high acceleration requirements.

BACKGROUND OF THE INVENTION

Closed loop air fuel mixture control using a zirconium dioxide sensor is known in the art in which the oxygen concentration of the exhaust emissions is sensed to generate an output which is utilized to generate a signal to control the engine's air fuel ratio at the stoichiometric value. Three-way catalytic convertors are desgined to operate at the stoichiometric value to convert the emissions to harmless water and carbon dioxide. With the engine operating at stoichiometry, the noxious emissions are reduced to a minimum. However, the closed loop control system would have disadvantages in that the controlled air fuel ratio permits no increase in the engine's output power, and the engine must be operated with less fuel than is needed for heavy load running.

Therefore, an object of the present invention is to provide a closed loop air fuel ratio control system for an automotive in which closed loop control is disabled or clamped to a miniumum by sensing full throttle position to permit reduction in the air fuel ratio below the stoichiometric value to allow the engine to give more power than normal when the vehicle is driven under heavy loading or high acceleration conditions.

Another object of the invention is to provide an improved closed loop air fuel ratio control system in which secondary air is supplied to a catalytic convertor when the air fuel ratio lowers below the stoichiometric value to compensate for the reduction in air during the heavy loading period to permit the convertor to operate at the maximum efficiency.

BRIEF DESCRIPTION OF THE DRAWING

The invention will understood by reference to the following detailed description taken in conjunction with the accompanying drawings, in which.

DETAILED DESCRIPTION OF THE PREFERRED EMBODIMENT

Figure 1:
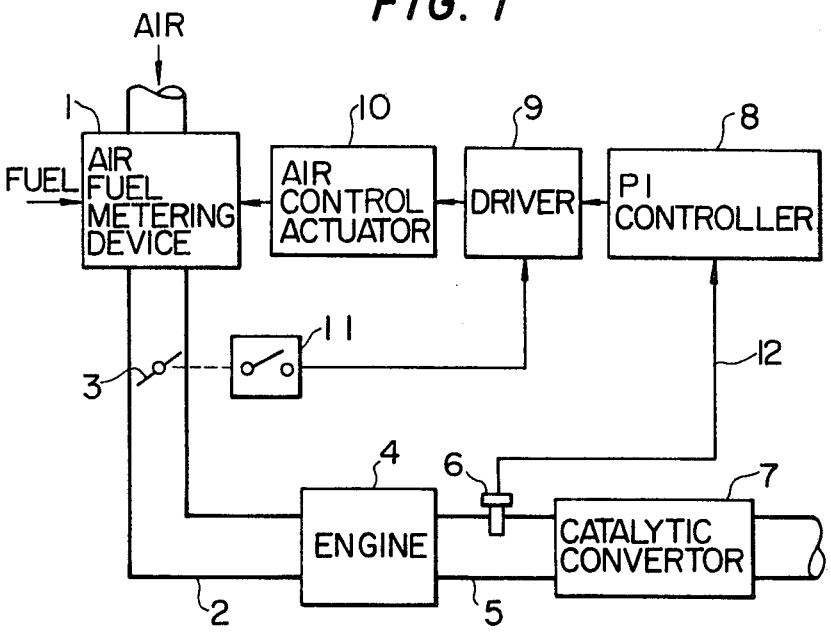
FIG. 1 is an embodiment of the present invention in which closed loop control is disabled.

Referring now to FIG. 1, an embodiment of the present invention is shown. Numeral 1 designates an air-fuel metering device which provides a metered amount of air and fuel to the engine 4 through air intake passage 2 in which a throttle valve 3 is disposed. An exhaust composition sensor 6 such as zirconium dioxide oxygen sensor is provided on the exhaust pipe 5 to sense the oxygen concentration of the exhaust emissions generated from engine 4. A catalytic convertor 7 is coupled to the exhaust pipe 5 to chemically convert the emissions to harmless water and carbon dioxide. The oxygen sensor 6 generates an output having a sharp characteristic change in amplitude at the stoichiometric value. The sensor 6 feeds its output through connection 12 to a proportional-integral controller 8 which will be described hereinbelow in detail. The output from the controller 8 is coupled to a driver circuit 9 which amplifies the input signal enough to actuate an air control actuator 10 which in turn controls the metering device 1 to adjust the amount of intake air. In accordance with the invention, a throttle which switch 11 is operatively connected to the throttle valve 3 to be actuated thereby when the throttle valve is substantially at its fully open position when the vehicle is driven under heavy load or rapidly accelerated. It is to be noted that an accelerator pedal switch may be connected to the accelerator pedal (not shown) to be operated when the pedal is fully depressed, to take the place of the throttle switch 11 since both function as a sensor to detect the full loading or high acceleration conditions. The throttle switch 11 supplies a signal to the driver circuit 9 when the throttle is at the fully open position. As will be described hereinbelow, the driver 9 will cut off its output, and the actuator 10 functions to control the metering device 1 to minimize the supply of air to the engine 4. Under this condition, closed loop control is disabled and the engine's air-fuel ratio lowers below the stoichiometeric value at which the signal from sensor 6 is controlled. Consequently, the amount of fuel is increased to meet the demand under the full loading or high acceleration conditions.

Figure 3:
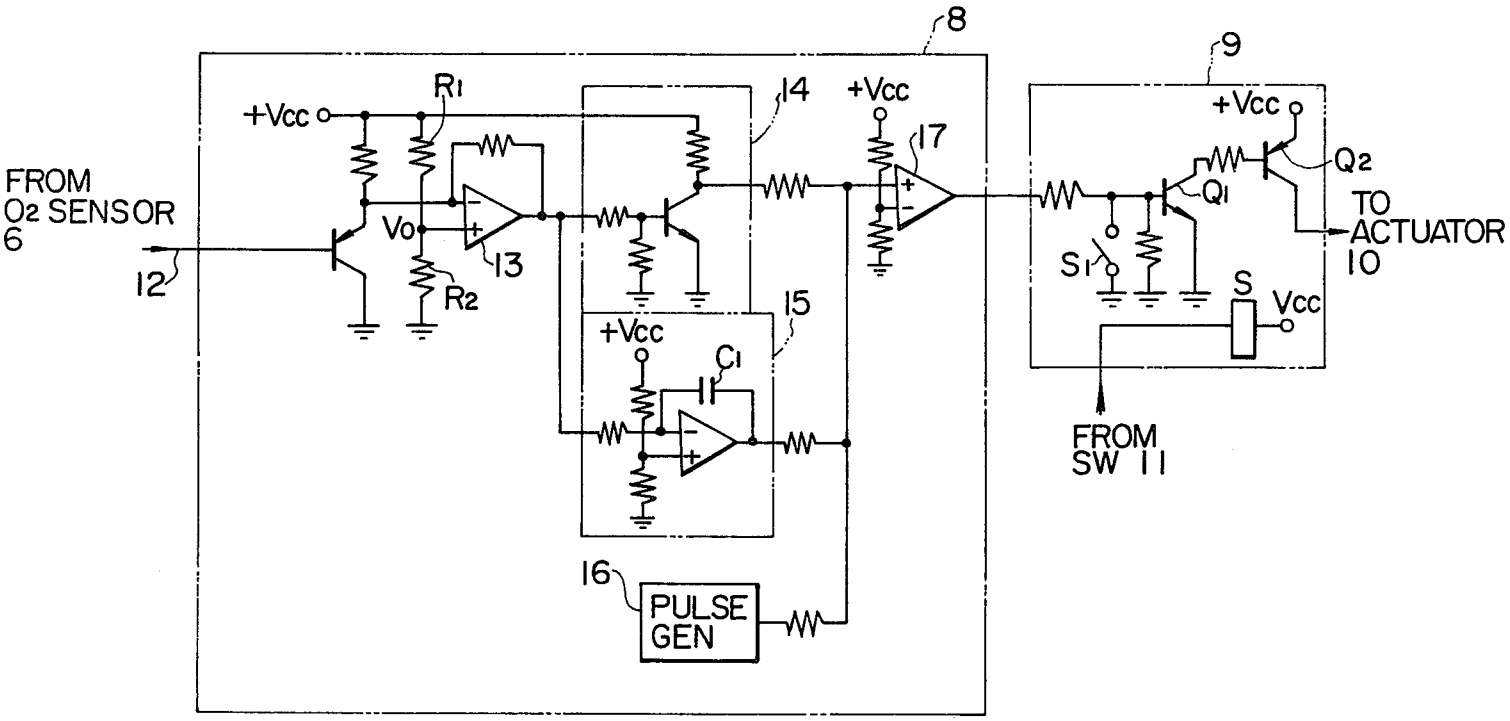
FIG. 3 is a detailed circuit diagram of the embodiment of FIG. 1.

A circuit shown in FIG. 3 may be employed for the proportional-integral controller 8 and driver 9 of FIG. 1. in FIG. 3, the PI controller 8 includes a comparator formed by an operational amplifier 13 having its inverting input terminal connected to the emitter of an input transistor amplifier which amplifies the input signal applied through connection 12. A voltage divider network comprised of a pair of series-connected resistors R1 and R2 is connected between the voltage source Vcc and ground to feed a reference potential Vo from a point intermediate the two resistors to the noninverting input terminal of operational amplifier 13. An excessive input voltage will produce an output representing the difference between the input voltage from the sensor 6 and the reference voltage Vo and is applied to a proportional controller circuit 14 and to an integral controller circuit 15. The proportional amplifier 14 generates an output proportional in amplitude to the input voltage. The integral controller 15 comprises an operational amplifier integrating circuit which charges its integrating capacitor C1 in the presence of the input voltage. The output from the proportional and integral amplifiers 14 and 15 are fed to the noninverting input terminal of an operational amplifier 17. A pulse generator 16 is provided to supply a train of triangular pulses to the noninverting input of 17. The inverting amplifier 17 has its inverting input terminal connected to a reference potential to convert the voltage applied to the noninverting terminal into a train of rectangular pulses at the same repetition rate as the triangular pulses with variable pulse duration depending on the amplitude of the combined output from amplifiers 14 and 15. The PI controller 8 feeds its output to the base electrode of an emitter-grounded n-p-n transistor Q1 of the driver circuit 9. The collector of Q1 is connected to the base a p-n-p transistor Q2 which amplifies the output from Q1 and feeds it to the actuator 10. A control switch S1 is connected across the base and emitter electrodes of transistor Q1. Switch S1 is a relay contact operated by energization of a relay coil "S" through operation of throttle switch 11. When the switch S1 is closed by energization of relay "S" the base potential drops to zero and the output from the driver 9 goes low to thereby decrease the amount of air introduced to a minimum.

Figure 2:
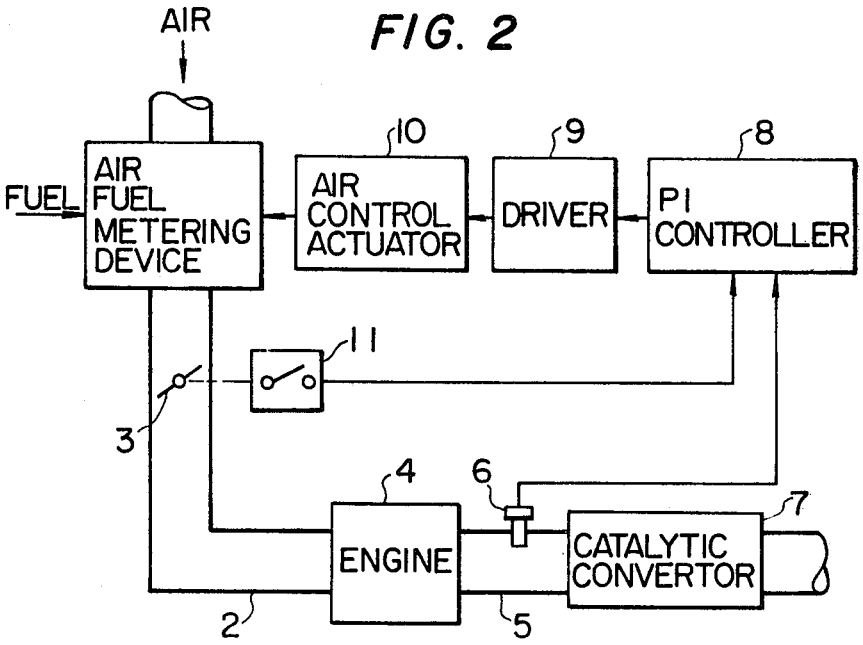
FIG. 2 is an alternative embodiment of the invention in which closed loop control is clamped to a minimum.
Figure 4:
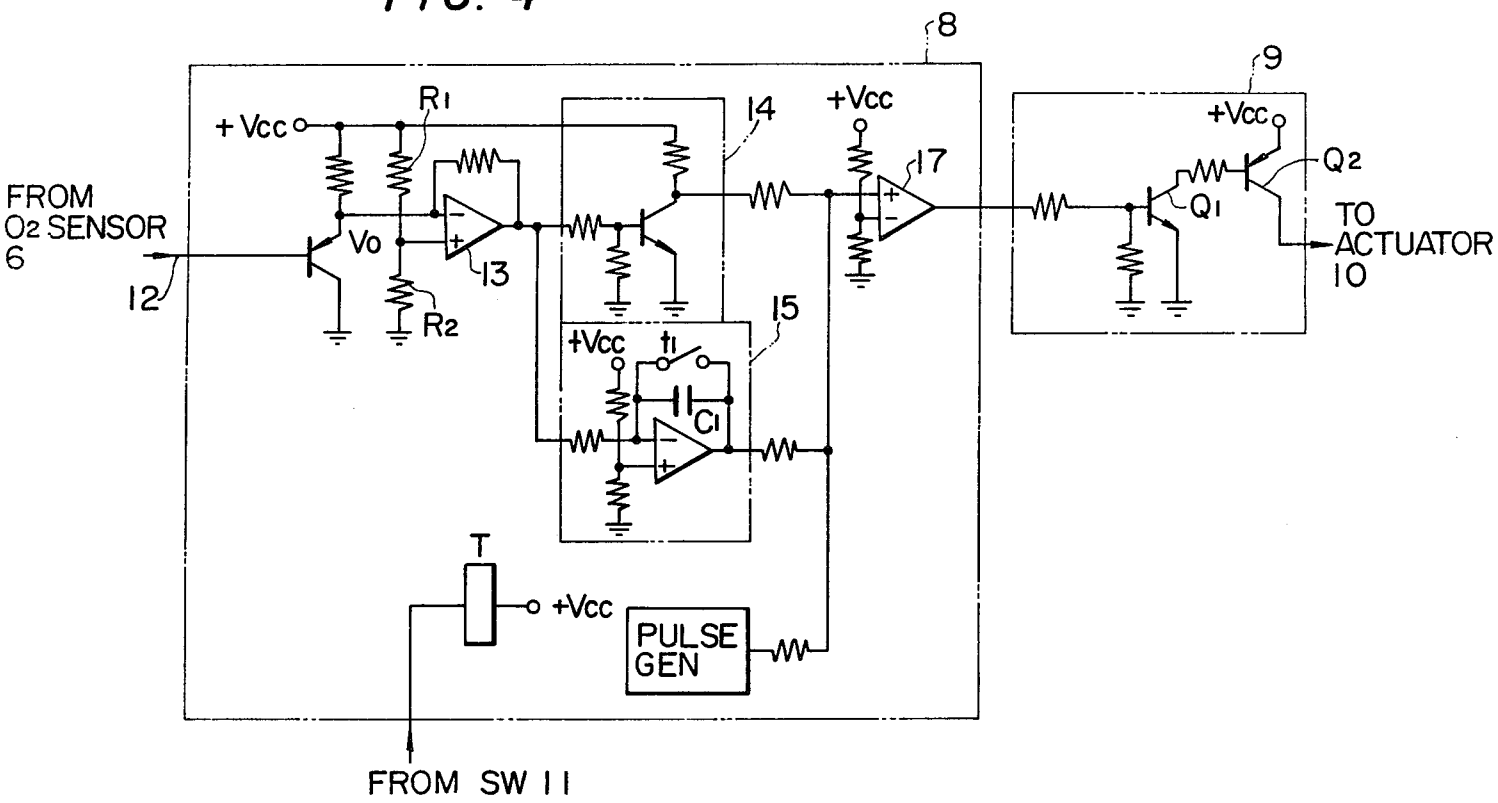
FIGS. 4 and 5 are detailed circuit diagrams of the FIG. 2 embodiment.

An alternative method of minimizing the supply of air is shown in FIGS. 2 and 4, in which similar numerals are used to indicate similar parts to those in FIGS. 1 and 3. The circuit of FIG. 2 is similar in general to that of FIG. 1 with the exception that the connection from throttle switch 11 is made to the PI controller 8 to disable the integrating action of integral amplifier or controller 15. In FIG. 4, the integral controller 15 includes a relay "T" which is connected to be energized by the throttle switch 11 when closed. The integrating capacitor C1 of the controller 15 is shunted by the relay contact $t_1$ of the relay "T". When relay T is operated by switch 11 closing its contact $t_1$ the charge stored on the capacitor C1 will be released into the short circuit provided by the contact $t_1$ and the output from the controller 15 is maintained at a constant level, while leaving the output from the proportional amplifier 14 to be varied in accordance with the input voltage. The system is thus changed to operate in the proportional control mode. In this mode of operation, the output from the PI controller 8 will be held within a range determined by the output of proportional controller 14 even when the sensed voltage from oxygen sensor 6 rises above the reference voltage Vo, i.e. when the engine's air-fuel ratio is below the stoichiometric value. Therefore, the engine's air fuel ratio is maintained at a value lower than stoichiometry.

When the vehicle comes out of the heavy load condition, the throttle switch 11 will be released to open the relay contact $t_1$ to allow charge to be stored on capacitor C1 again to resume integral operation. Since the charge will build up from the minimum, the voltage output from the integral controller 15 will rise gradually. This is an advantageous feature of the embodiment of FIGS. 2 and 4 since abrupt change in voltage to the actuator 10 is not desirable when the system resumes its feedback control.

Figure 5:
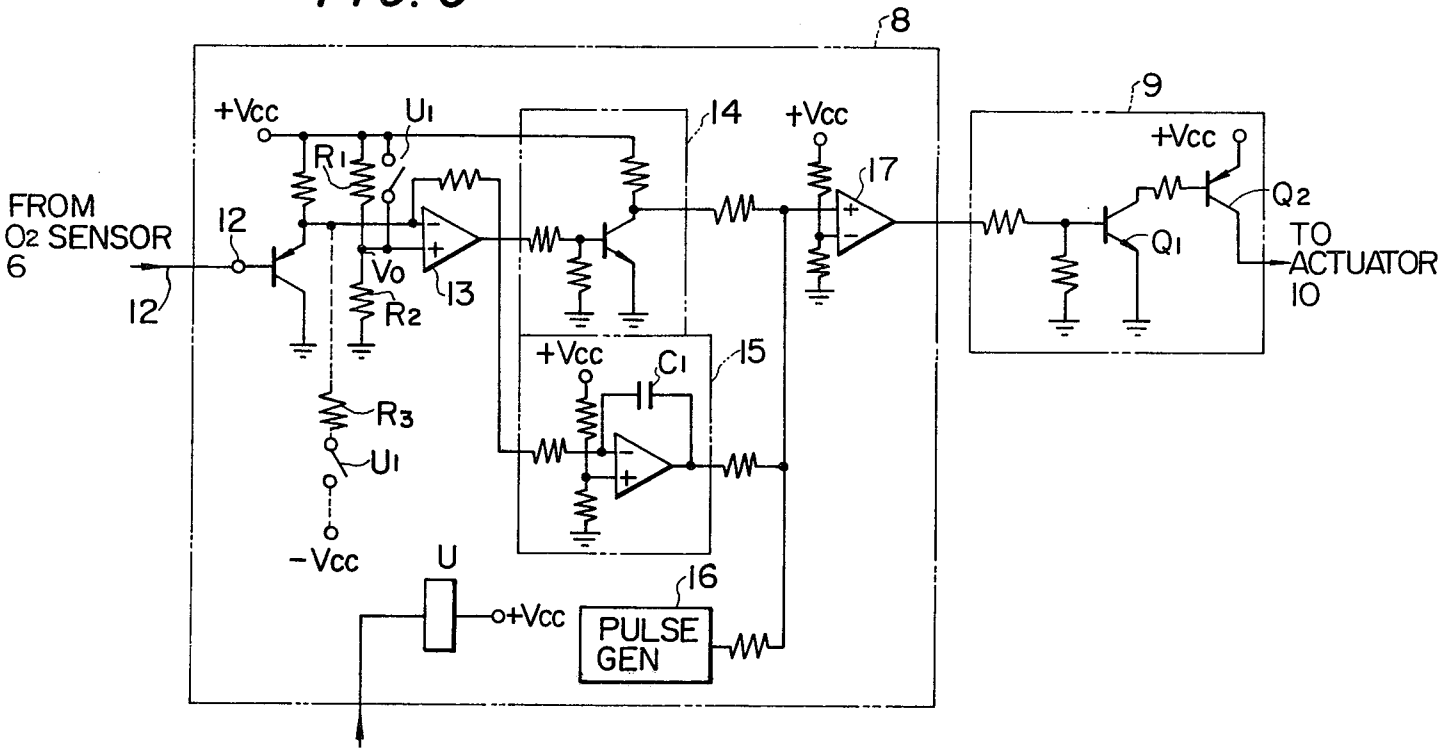

Alternatively, rely contact contact $u_1$ is connected across resistor R1 as shown in FIG. 5 to bring the reference voltage Vo to the same level as the source voltage +Vcc when relay U is operated by the signal from the throttle position switch 11. With Vo at the source voltage, the voltage on the inverting input terminal of the amplifier 13 is always below the voltage Vo on the non-inverting input terminal so that the amplifier 13 produce a positive voltage of the magnitude greater than the voltage on the non-inverting input terminal of amplifier 15. As a result, the amplifier 15 produces a negative voltage at its output and the width of the pulses from the amplifier 17 is reduced to a minimum. The operating time of the actuator 10 is thus brought to a minimum to reduce the engine's air fuel ratio below the stoichiometric value. Relay contact $u_1$ may be alternatively connected between a negative supply −Vcc and the inverting input of amplifier 13 through resistor $R_3$.

Figure 6:
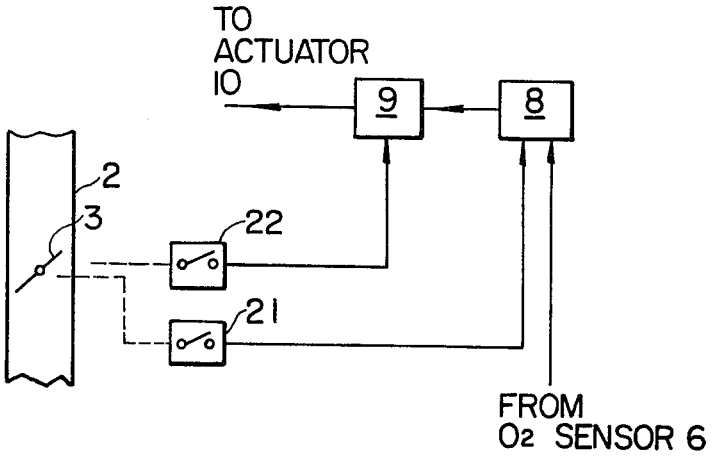
FIG. 6 is another embodiment of the invention in which closed loop control is progressively varied in accordance with the degree of loading.

In FIG. 6 throttle switches 21 and 22 are operatively connected to the throttle valve 3 in such manner that switch 21 is operated first prior to the operation of switch 22 when the throttle valve 3 is approaching its fully open position. With the first-actuated switch 21 operated, the output PI controller 8 is controlled as previously described in connection with the embodiments of FIGS. 4 or 5, and then with the switch 22 being operated in succession by further depression of the accelerator pedal, the driver circuit 9 is disabled in a manner as previously described in connection with the embodiment of FIG. 3. When accelerator pedal is restored, switch 22 is first open prior to the turn-off of switch 21. In this arrangement the actuating pulse duration is first brought to a minimum by operation of switch 21, and then the pulse completely disappears by operation of switch 22. This progressive operation of throttle switches prevents the introduction of an abrupt change to the system to avoid system hunting when feedback control is resumed.

Since it is a rare occasion that the throttle valve is brought to its fully open position, the system of the invention will not practically produce an excessive amount of pollutants due to the departure from the stoichiometric air fuel ratio under normal driving conditions. However, when vehicle is climbing a step upward slope the unfavorable condition may sometimes exist for a certain period of time.

Figure 7:
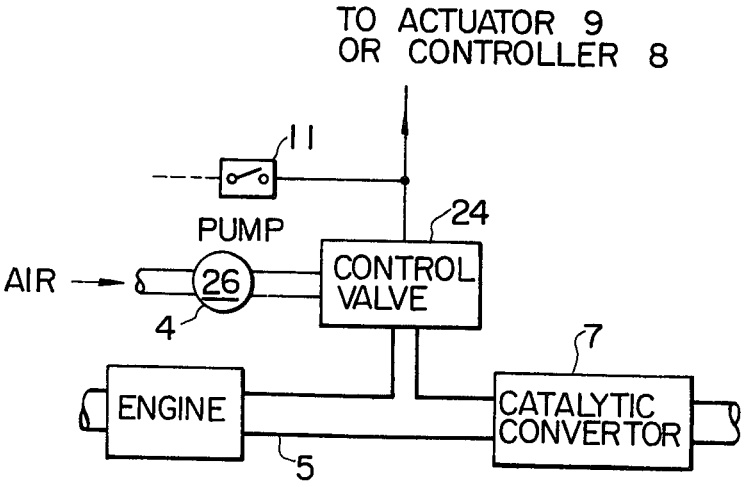
FIG. 7 shows an arrangement for introducing secondary air to a catalytic convertor to maximize its efficiency when closed loop control is disabled or clamped to a minimum.

FIG. 7 illustrates an arrangement in which a secondary air is introduced to the catalytic converter 7, when the engine's air fuel ratio is reduced below stoichiometry, by the amount which compensates for the reduction in air-fuel ratio so that catalytic convertor 7 may operate at its best efficiency. In the arrangement of FIG. 7, a control valve 24 is provided to supply the necessary secondary air to the exhaust pipe 5 by means of a pump 26 which forces the air to enter the catalytic convertor 7. The control valve 24 is operated by the signal from throttle switch 11 when operated at substantially full throttle position.

In the foregoing description, the mixture control has been effected by controlling the amount of air to be inducted into the cylinders. It is obvious to provide mixture control by varying the amount of fuel instead of by controlling the amount of air. The throttle switch 11 is designed to operate when the throttle valve is in the neighborhood of its fully open position. The term "substantially at its fully open position" used throughout the specification should be interpreted to mean that the throttle valve is in the neighborhood of its fully or completely open position.

What is claimed is:

1. A closed loop mixture control system for an internal combustion engine having an air intake passage, a throttle therein, means for supplying air and fuel thereto and exhaust means, comprising:

means for generating a first signal indicative of the deviation of the air-fuel ratio within said exhaust means from a fixed reference;

an integrating controller including integrator means for providing integration of said first signal to suppress a control oscillation caused by a time lag inherent in the closed loop, said integrator means including an operational amplifier having a first input receptive of said first signal and a second input connected to a predetermined potential, and a capacitor connected between said first input and output of said amplifier to generate a control signal effective to cause said air fuel supply means to vary the ratio of air and fuel supplied to said engine in accordance with the direction of the deviation of said air-fuel ratio from said fixed reference;

means for sensing when said throttle is in a fully open position; and switching means selectively providing a short-circuit path across said capacitor in response to the sensing means so that, with the throttle fully open, the output from said integrating controller is operated in a proportional mode and maintained at such a value that said air fuel supply means is caused to supply an enriched mixture to said engine, and when said throttle is varied from said fully open position to a part throttle position, said integrating controller commences operation in an integration mode for integration of said first signal and generates an output effective to cause said air fuel supply means to supply a leaner mixture to said engine.

* * * * *